US010059485B2

(12) United States Patent
Spivey, Sr. et al.

(10) Patent No.: US 10,059,485 B2
(45) Date of Patent: Aug. 28, 2018

(54) CARTON WITH HANDLE

(71) Applicant: Graphic Packaging International, Inc., Atlanta, GA (US)

(72) Inventors: Raymond R. Spivey, Sr., Mableton, GA (US); Graham Hand, Roswell, GA (US); Michael Cerio, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/372,477

(22) Filed: Dec. 8, 2016

(65) Prior Publication Data

US 2017/0158374 A1 Jun. 8, 2017

Related U.S. Application Data

(60) Provisional application No. 62/264,535, filed on Dec. 8, 2015.

(51) Int. Cl.
*B65D 5/468* (2006.01)
*B65D 5/08* (2006.01)
(Continued)

(52) U.S. Cl.
CPC ..... *B65D 5/4608* (2013.01); *B31B 1/25* (2013.01); *B31B 1/26* (2013.01); *B31B 1/86* (2013.01);
(Continued)

(58) Field of Classification Search
CPC .... B31B 1/25; B31B 1/26; B31B 1/86; B31B 7/00; B65B 69/00; B65D 5/02;
(Continued)

(56) References Cited

U.S. PATENT DOCUMENTS 1,253,193 A 1/1918 Hill
2,383,183 A 8/1945 Fischer
(Continued)

FOREIGN PATENT DOCUMENTS

CA 877792 8/1971
CA 2 160 145 9/1995
(Continued)

OTHER PUBLICATIONS

International Search Report and Written Opinion for PCT/US2016/065492 dated Mar. 24, 2017.

*Primary Examiner* — Bryon Gehman
(74) *Attorney, Agent, or Firm* — Womble Bond Dickinson (US) LLP

(57) ABSTRACT

A carton for holding a plurality of articles. The carton has a plurality of panels that extends at least partially around an interior of the carton. The plurality of panels include a bottom panel, a first side panel, a second side panel, a top panel, and a handle panel at least partially overlapping one of the first side panel and the second side panel. At least one gusset is foldably connected to the bottom panel and one of the first side panel and the second side panel. An access feature is formed in the top panel for accessing the interior of the carton. A handle includes a handle opening in the handle panel. The handle opening is spaced apart from the access feature.

35 Claims, 4 Drawing Sheets

(51) Int. Cl.

| | |
|---|---|
| ***B65D 5/42*** | (2006.01) |
| ***B65D 5/54*** | (2006.01) |
| ***B65D 71/36*** | (2006.01) |
| ***B31B 1/25*** | (2006.01) |
| ***B31B 1/26*** | (2006.01) |
| ***B31B 1/86*** | (2006.01) |

(52) U.S. Cl.
CPC ..... *B65D 5/08* (2013.01); *B65D 5/4266* (2013.01); *B65D 5/542* (2013.01); *B65D 71/36* (2013.01)

(58) Field of Classification Search
CPC ..... B65D 5/08; B65D 5/42; B65D 5/4266; B65D 5/46; B65D 5/4608; B65D 5/462; B65D 5/468; B65D 5/50; B65D 5/52; B65D 5/54; B65D 5/542; B65D 71/34; B65D 71/36
USPC ..... 206/427, 429, 430, 434
See application file for complete search history.

(56) References Cited

U.S. PATENT DOCUMENTS

| | | | |
|---|---|---|---|
| 2,594,376 | A | 4/1952 | Arneson |
| 2,702,144 | A | 2/1955 | Forrer |
| 2,797,856 | A | 7/1957 | Jaeschke |
| 2,810,506 | A | 10/1957 | Kessler |
| 2,819,506 | A | 10/1957 | Kessler |
| 2,868,433 | A | 1/1959 | Anderson, Jr. |
| 2,955,739 | A | 10/1960 | Collura |
| 3,112,856 | A | 12/1963 | MacIntosh et al. |
| 3,127,720 | A | 4/1964 | Gentry et al. |
| 3,204,814 | A | 9/1965 | Mahon |
| 3,204,815 | A | 9/1965 | Weis |
| 3,309,005 | A | 3/1967 | Pilger |
| 3,334,767 | A | 8/1967 | Cornelius et al. |
| 3,355,012 | A | 11/1967 | Weiss |
| 3,381,881 | A | 5/1968 | Granz et al. |
| 3,828,926 | A | 8/1974 | Rossi |
| 3,886,901 | A | 6/1975 | Zeitter |
| 3,894,681 | A | 7/1975 | Arneson et al. |
| 3,904,036 | A | 9/1975 | Forrer |
| 3,933,303 | A | 1/1976 | Kirby, Jr. |
| 3,994,432 | A | 11/1976 | Kirby, Jr. |
| 4,029,204 | A | 6/1977 | Manizza |
| 4,036,423 | A | 7/1977 | Gordon |
| 4,096,985 | A | 6/1978 | Wood |
| 4,111,306 | A | 9/1978 | Roccaforte |
| 4,216,861 | A | 8/1980 | Oliff |
| 4,318,474 | A | 3/1982 | Hasegawa |
| 4,328,923 | A | 5/1982 | Graser |
| 4,329,923 | A | 5/1982 | Iida |
| 4,331,289 | A | 5/1982 | Killy |
| 4,364,509 | A | 12/1982 | Holley et al. |
| 4,375,258 | A | 3/1983 | Crayne et al. |
| 4,378,905 | A | 4/1983 | Roccaforte |
| 4,382,505 | A | 5/1983 | Sutherland et al. |
| 4,396,143 | A | 8/1983 | Killy |
| 4,418,864 | A | 12/1983 | Nielsen |
| 4,424,901 | A | 1/1984 | Lanier |
| 4,440,340 | A | 4/1984 | Bakx |
| 4,478,334 | A | 10/1984 | Graser |
| 4,498,619 | A | 2/1985 | Roccaforte |
| 4,508,258 | A | 4/1985 | Graser |
| 4,538,759 | A | 9/1985 | Dutcher |
| 4,545,485 | A | 10/1985 | Oliff |
| 4,546,914 | A | 10/1985 | Roccaforte |
| 4,577,799 | A | 3/1986 | Oliff |
| 4,582,199 | A | 4/1986 | Schuster |
| 4,588,084 | A | 5/1986 | Holley |
| 4,653,686 | A | 3/1987 | Wood et al. |
| 4,706,876 | A | 11/1987 | Wilson |
| 4,747,487 | A | 5/1988 | Wood |
| 4,784,266 | A | 11/1988 | Chaussadas |
| 4,784,316 | A | 11/1988 | Crouch |
| 4,802,583 | A | 2/1989 | Calvert et al. |
| 4,830,267 | A | 5/1989 | Wilson |
| 4,875,586 | A | 10/1989 | Chaussadas |
| 4,966,324 | A | 10/1990 | Steel |
| 5,020,337 | A | 6/1991 | Krieg |
| 5,060,792 | A | 10/1991 | Oliff |
| 5,072,876 | A | 12/1991 | Wilson |
| 5,094,359 | A | 3/1992 | DeMars et al. |
| 5,106,014 | A | 4/1992 | Miller |
| 5,119,985 | A | 6/1992 | Dawson et al. |
| 5,197,598 | A | 3/1993 | Stout et al. |
| 5,221,041 | A | 6/1993 | Stout et al. |
| 5,222,658 | A | 6/1993 | DeMaio et al. |
| 5,234,102 | A | 8/1993 | Schuster et al. |
| 5,246,112 | A | 9/1993 | Stout et al. |
| 5,284,294 | A | 2/1994 | Floyd |
| 5,292,058 | A | 3/1994 | Zoss et al. |
| 5,297,725 | A | 3/1994 | Sutherland |
| 5,303,863 | A | 4/1994 | Arasim |
| 5,307,932 | A | 5/1994 | Stout et al. |
| 5,307,986 | A | 5/1994 | Schuster |
| 5,320,277 | A | 6/1994 | Stout et al. |
| 5,328,081 | A | 7/1994 | Saulas |
| 5,333,734 | A | 8/1994 | Stout et al. |
| D350,480 | S | 9/1994 | Sutherland |
| 5,379,944 | A | 1/1995 | Stout et al. |
| 5,381,891 | A | 1/1995 | Harris |
| 5,385,234 | A | 1/1995 | Stout et al. |
| 5,395,044 | A | 3/1995 | Stout |
| 5,427,241 | A | 6/1995 | Sutherland |
| 5,458,234 | A | 10/1995 | Harris |
| 5,472,090 | A | 12/1995 | Sutherland |
| 5,485,915 | A | 1/1996 | Harris |
| 5,495,727 | A | 3/1996 | Strong et al. |
| 5,524,756 | A | 6/1996 | Sutherland |
| 5,551,556 | A | 9/1996 | Sutherland |
| 5,582,343 | A | 12/1996 | Dalvey |
| 5,593,027 | A | 1/1997 | Sutherland |
| 5,595,292 | A | 1/1997 | Bates |
| 5,639,017 | A | 6/1997 | Fogle |
| 5,647,483 | A | 7/1997 | Harris |
| 5,669,500 | A | 9/1997 | Sutherland |
| 5,699,957 | A | 12/1997 | Blin et al. |
| 5,704,470 | A | 1/1998 | Sutherland |
| 5,738,273 | A | 4/1998 | Auclair |
| 5,739,273 | A | 4/1998 | Engelman et al. |
| 5,794,778 | A | 8/1998 | Harris |
| 5,796,778 | A | 8/1998 | Kurker |
| 5,826,782 | A | 10/1998 | Stout |
| 5,873,515 | A | 2/1999 | Dunn et al. |
| 5,878,946 | A | 3/1999 | Frerot et al. |
| 5,906,313 | A | 5/1999 | Oliff |
| 5,915,546 | A | 6/1999 | Harrelson |
| 5,992,733 | A | 11/1999 | Gomes |
| 6,019,276 | A | 2/2000 | Auclair |
| 6,021,897 | A | 2/2000 | Sutherland |
| 6,065,590 | A | 5/2000 | Spivey |
| 6,085,969 | A | 7/2000 | Burgoyne |
| 6,105,853 | A | 8/2000 | Lamare |
| 6,105,854 | A | 8/2000 | Spivey et al. |
| 6,112,977 | A | 9/2000 | Sutherland et al. |
| 6,129,266 | A | 10/2000 | Oliff et al. |
| 6,131,803 | A | 10/2000 | Oliff et al. |
| 6,164,526 | A | 12/2000 | Dalvey |
| 6,170,741 | B1 | 1/2001 | Skolik et al. |
| 6,227,367 | B1 | 5/2001 | Harrelson et al. |
| 6,260,755 | B1 | 7/2001 | Bates et al. |
| 6,302,320 | B1 | 10/2001 | Stout |
| D452,154 | S | 12/2001 | Rhodes et al. |
| 6,425,520 | B1 | 7/2002 | Peterson |
| 6,523,739 | B2 | 2/2003 | Heeley et al. |
| 6,536,656 | B2 | 3/2003 | Auclair et al. |
| 6,631,803 | B2 | 10/2003 | Rhodes et al. |
| 6,758,337 | B2 | 7/2004 | Chargueraud et al. |
| 6,766,940 | B2 | 7/2004 | Negelen |
| 6,834,793 | B2 | 12/2004 | Sutherland |
| 6,848,573 | B2 | 2/2005 | Gould et al. |
| 6,869,009 | B2 | 3/2005 | Sutherland et al. |

(56) References Cited

U.S. PATENT DOCUMENTS

| | | | | |
|---|---|---|---|---|
| 6,905,066 | B2 | 6/2005 | Holley et al. | |
| 6,918,487 | B2 * | 7/2005 | Harrelson | B65D 71/36 206/427 |
| 6,926,193 | B2 | 8/2005 | Smalley | |
| 6,945,450 | B2 | 9/2005 | Rusnock | |
| 6,968,992 | B2 | 11/2005 | Schuster | |
| 7,234,596 | B2 | 6/2007 | Lebras | |
| 7,296,731 | B2 | 11/2007 | Auclair et al. | |
| 7,380,701 | B2 | 6/2008 | Fogle et al. | |
| 7,416,109 | B2 | 8/2008 | Sutherland | |
| 7,427,010 | B2 | 9/2008 | Sutherland | |
| 7,472,791 | B2 | 1/2009 | Spivey, Sr. | |
| 7,601,111 | B2 | 10/2009 | Sutherland et al. | |
| 7,699,215 | B2 | 4/2010 | Spivey, Sr. | |
| 7,743,944 | B2 | 6/2010 | Ho Fung et al. | |
| 7,743,968 | B2 | 6/2010 | Theelen | |
| 7,748,603 | B2 | 7/2010 | Fogle et al. | |
| 7,757,933 | B2 | 7/2010 | Dunn | |
| 7,793,779 | B2 | 9/2010 | Spivey, Sr. et al. | |
| 7,806,314 | B2 | 10/2010 | Sutherland | |
| 8,191,761 | B2 | 6/2012 | Brand | |
| 8,978,963 | B2 | 3/2015 | Kastanek et al. | |
| 9,248,933 | B2 * | 2/2016 | Spivey, Sr. | B65D 5/46088 |
| 2003/0213263 | A1 | 11/2003 | Woog | |
| 2004/0050917 | A1 | 3/2004 | Smalley | |
| 2004/0074954 | A1 | 4/2004 | Fogle et al. | |
| 2004/0238611 | A1 | 12/2004 | Sutherland | |
| 2005/0056658 | A1 | 3/2005 | Spivey | |
| 2005/0087592 | A1 | 4/2005 | Schuster | |
| 2005/0167478 | A1 | 8/2005 | Holley, Jr. | |
| 2006/0071058 | A1 | 4/2006 | Spivey, Sr. | |
| 2006/0169755 | A1 | 8/2006 | Spivey, Sr. | |
| 2006/0273143 | A1 | 12/2006 | Finch | |
| 2007/0039846 | A1 | 2/2007 | Spivey, Sr. | |
| 2007/0051781 | A1 | 3/2007 | Holley, Jr. | |
| 2007/0108261 | A1 | 5/2007 | Schuster | |
| 2007/0164091 | A1 | 7/2007 | Fogle et al. | |
| 2007/0181658 | A1 | 8/2007 | Sutherland | |
| 2007/0205255 | A1 | 9/2007 | Dunn | |
| 2007/0284424 | A1 | 12/2007 | Holley | |
| 2007/0295789 | A1 | 12/2007 | Ho Fung | |
| 2008/0073420 | A1 | 3/2008 | Walling et al. | |
| 2008/0083820 | A1 | 4/2008 | Walling et al. | |
| 2008/0099544 | A1 | 5/2008 | Skolik | |
| 2008/0119344 | A1 | 5/2008 | Sutherland et al. | |
| 2009/0236408 | A1 | 9/2009 | Spivey, Sr. | |
| 2009/0255983 | A1 | 10/2009 | De Paula et al. | |
| 2010/0044420 | A1 | 2/2010 | Brand | |
| 2010/0213249 | A1 | 8/2010 | Requena | |
| 2012/0211552 | A1 | 8/2012 | Kastanek et al. | |
| 2013/0213991 | A1 | 8/2013 | Harrelson | |
| 2014/0228192 | A1 | 8/2014 | Schuster | |

FOREIGN PATENT DOCUMENTS

| | | |
|---|---|---|
| DE | 85 14 718.4 | 6/1985 |
| DE | 296 07 374 | 4/1996 |
| DE | 201 12 228 | 11/2002 |
| DE | 20 2004 018 649 | 4/2005 |
| EP | 0 412 226 | 2/1991 |
| EP | 0 473 266 | 3/1992 |
| EP | 1 612 157 | 1/2006 |
| FR | 1 494 239 | 9/1967 |
| FR | 2 579 175 | 9/1986 |
| JP | 06-32320 | 4/1994 |
| JP | 2007 055630 | 3/2007 |
| JP | 2008-013200 | 1/2008 |
| JP | 2013-173546 A | 9/2013 |
| KR | 20-0356729 | 7/2004 |
| KR | 10-2015-0031088 A | 3/2015 |
| WO | WO 96/27538 | 9/1996 |
| WO | WO 99/28207 | 6/1999 |
| WO | WO 00/78618 | 12/2000 |
| WO | WO 01/66434 | 9/2001 |
| WO | WO 03/037742 | 5/2003 |
| WO | WO 2005/080218 | 9/2005 |
| WO | WO 2005/123532 | 12/2005 |
| WO | WO 2007/089282 | 8/2007 |

* cited by examiner

CARTON WITH HANDLE

CROSS-REFERENCE TO RELATED APPLICATION

The present application claims the benefit of U.S. Provisional Patent Application No. 62/264,535 filed on Dec. 8, 2015.

INCORPORATION BY REFERENCE

The disclosure of U.S. Provisional Patent Application No. 62/264,535, filed on Dec. 8, 2015, is hereby incorporated by reference for all purposes as if presented herein it its entirety.

BACKGROUND OF THE DISCLOSURE

The present disclosure generally relates to a carton for handling and carrying containers, and particularly to cartons having a handle.

SUMMARY OF THE DISCLOSURE

According to one aspect, the disclosure is generally directed to a carton for holding a plurality of articles. The carton comprising a plurality of panels that extends at least partially around an interior of the carton. The plurality of panels comprising a bottom panel, a first side panel, a second side panel, a top panel, and a handle panel at least partially overlapping one of the first side panel and the second side panel. At least one gusset is foldably connected to the bottom panel and one of the first side panel and the second side panel. An access feature is formed in the top panel for accessing the interior of the carton. A handle comprises a handle opening in the handle panel. The handle opening is spaced apart from the access feature.

According to another aspect, the disclosure is generally directed to a blank for forming a carton for holding a plurality of articles. The blank comprises a plurality of panels comprising a bottom panel, a first side panel, a second side panel, a top panel, and a handle panel for at least partially overlapping one of the first side panel and the second side panel in the carton formed from the blank. At least one gusset is foldably connected to the bottom panel and one of the first side panel and the second side panel. An access feature is formed in the top panel for accessing the interior of the carton formed from the blank. Handle features comprise a handle opening in the handle panel. The handle opening is spaced apart from the access feature in the carton formed from the blank.

According to another aspect, the disclosure is generally directed to a method of forming a carton for holding a plurality of articles. The method comprises obtaining a blank comprising a plurality of panels including a bottom panel, a first side panel, a second side panel, a top panel, and a handle panel at least partially overlapping one of the first side panel and the second side panel, at least one gusset foldably connected to the bottom panel and one of the first side panel and the second side panel, an access feature formed in the top panel, and handle features comprising a handle opening in the handle panel. The method comprises forming an interior of the carton for holding the plurality of articles by positioning the plurality of panels, and forming the handle by positioning the handle panel to at least partially overlap at least one of the first side panel and the second side panel. The handle opening is spaced apart from the access feature.

Other aspects, features, and details of the present disclosure can be more completely understood by reference to the following detailed description, taken in conjunction with the drawings and from the appended claims.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The embodiments of the present disclosure described below generally relate to a carton suitable for storing and dispensing articles such as, for example, beverage containers. The carton provides a bottom receptacle suitable for accommodating, for example, liquids, ice, or other cooling material in the carton bottom. In one exemplary embodiment, ice can be added to the opened top of the carton to cool beverage containers held within the carton. As the ice melts, all or a part of the resultant runoff water may be held within the bottom receptacle.

Articles accommodated within the present carton embodiments can include containers such as, for example, metallic beverage cans, glass or plastic bottles, or other containers such as, for example, those used in packaging beverages, foodstuffs, and other products. For the purposes of illustration and not for the purpose of limiting the scope of the disclosure, the following detailed description describes generally cylindrical metallic beverage containers as disposed within the carton. In this specification, the terms "side," "end," "bottom," and "top" indicate orientations determined in relation to fully erected, upright cartons.

Figure 1:
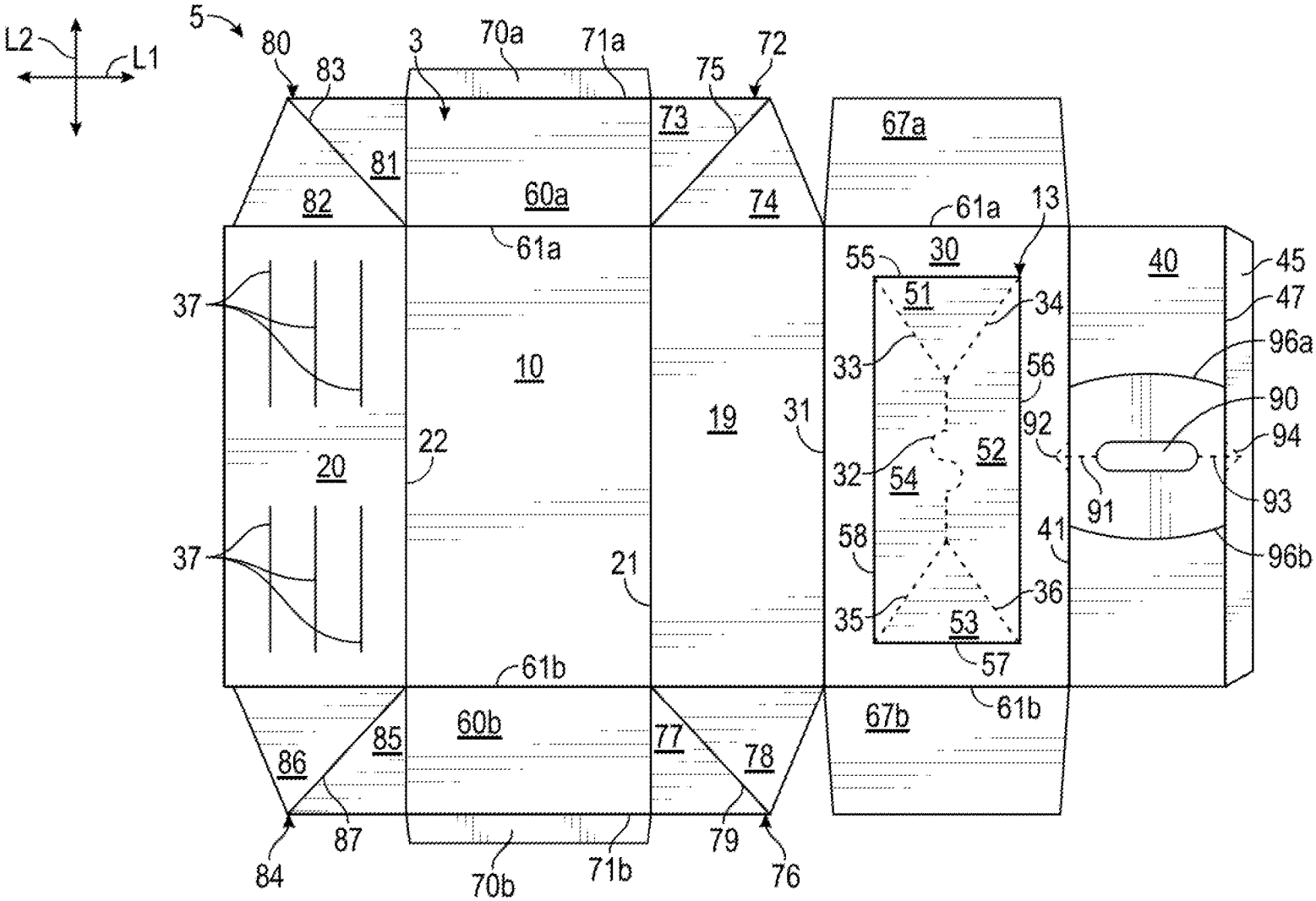
FIG. 1 is a plan view of a blank used to form a carton according to one embodiment of the disclosure.

FIG. 1 is a plan view of an exterior or printed surface 3 of a blank 5 used to form a carton 7 (illustrated in FIG. 5) according to one embodiment of the disclosure. The blank 5 has a longitudinal axis L1 extending along a length of the blank 5, and a lateral axis L2 extending along a width of the blank 5. As discussed in detail below, the carton 7 includes a bottom receptacle 11 (FIG. 7) for containing the beverage containers and that has an at least partially liquid-tight construction for retaining liquid, a top access or dispensing feature 13 for receiving ice or other cooling material and allowing access to an interior 8 (FIG. 4) of the carton 7 containing the beverage containers, and a handle 98 for allowing a consumer to lift and transport the carton 7 without engaging, contacting, or activating the top access feature 13. In the illustrated embodiment, the carton 7 is sized to house eighteen containers in a single layer in a 3×6 arrangement, but it is understood that the carton 7 may be sized and shaped to hold containers of a different or same quantity in more than one layer and/or in different row/column arrangements (e.g., 1×6, 3×4, 2×6×2, 3×4×2, 3×5, 4×5, 4×6, 2×9, 2×6, 4×4, etc.).

As illustrated, the blank 5 comprises a bottom panel 10, a first side panel 19 foldably connected to the bottom panel 10 at a lateral fold line 21, and a second side panel 20 foldably connected to the bottom panel 10 at lateral fold line 22. A top panel 30 is foldably connected to the first side panel 19 at a lateral fold line 31, and a handle panel 40 is foldably connected to the top panel 30 at a lateral fold line 41. In one embodiment, an attachment flap 45 is foldably connected to the handle panel 40 at a lateral fold line 47. The second side panel 20 may include score lines 37 that may facilitate relative movement of portions of the second side panel 20 during use of the carton 7 (FIG. 5), as described further herein. Lines of adhesive 36 may be applied to an interior surface 4 (FIG. 2) of the blank 5 along handle panel 40 and attachment flap 45 to facilitate formation of carton 7 from blank 5. Lines of adhesive 36 may be placed along the interior surface 4 of blank 5 along second side panel 20 to correspond to the arrangement of score lines 37 on the exterior surface 3 of blank 5 (not shown).

Figure 5:
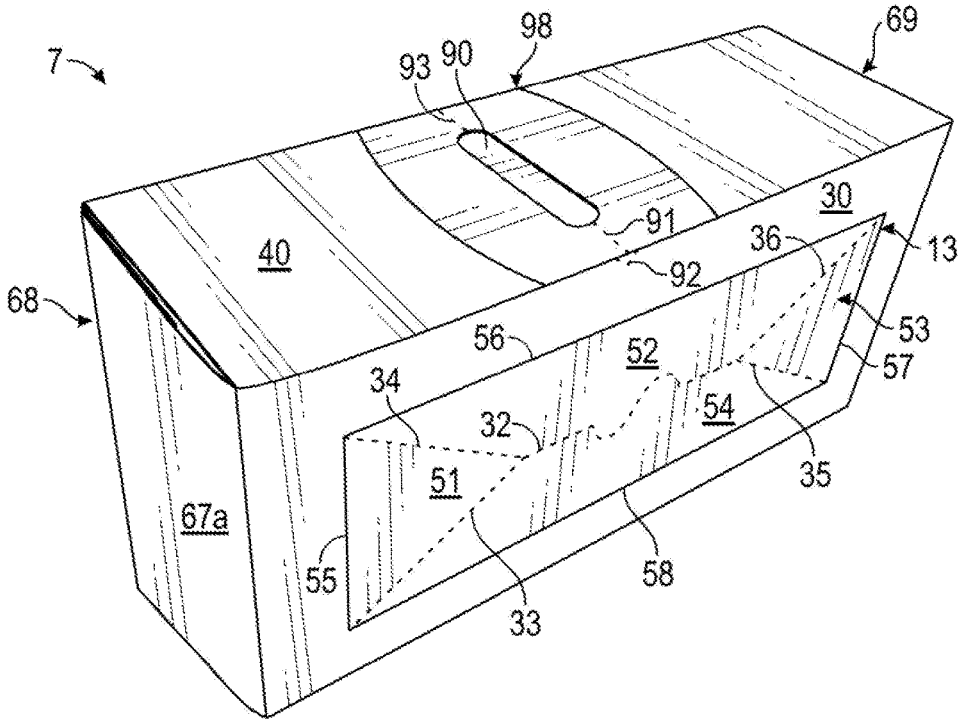
FIG. 5 is a fourth sequential view of a partial folding of the blank of FIG. 1 resulting in a fully formed carton according to one embodiment of the disclosure.

In one embodiment, the bottom panel 10 includes a first bottom end panel 60*a* foldably connected to a central portion of the bottom panel 10 at a longitudinal fold line 61*a*, and a second bottom end panel 60*b* foldably connected to the central portion of the bottom panel 10 at a longitudinal fold line 61*b*. A closure flap 70*a* is foldably connected to a distal end of bottom end panel 60*a* at a longitudinal fold line 71*a* and a closure flap 70*b* is foldably connected to a distal end of bottom end panel 60*b* at a longitudinal fold line 71*b*. One or both of closure flaps 70*a*, 70*b* may be configured as adhesive flaps, or may have an adhesive applied to one or more surfaces thereof during assembly of blank 5 into carton 7 (FIG. 5). In this specification, the terms "end" and "side" are used for ease of reference, and do not imply relative sizes of the end panels 60*a*, 60*b* and the side panels 19, 20, for example. The closure flaps 70*a*, 70*b* and fold lines 71*a*, 71*b* could be otherwise shaped, arranged, configured and/or omitted without departing from the disclosure.

The top access feature 13 in the top panel 30 may include a breachable line of disruption or tear line 32 extending generally in the lateral direction L2. In one embodiment, the tear line 32 includes bifurcated ends having bifurcated tear lines 33, 34, 35, 36 forming four top access flaps 51, 52, 53, 54 that are foldably connected to the top panel 30 at respective fold lines 55, 56, 57 58. As shown, the tear line 32 may include a serpentine or sinusoidal section along a portion thereof, as described further herein. Top end flaps 67*a*, 67*b* are foldably connected at respective ends of the top panel 30 at respective longitudinal fold lines 61*a*, 61*b*. The top panel 30 and the top access feature 13 could have other features and/or be otherwise shaped, arranged, and/or configured without departing from the disclosure.

As illustrated, gussets 72, 76, 80, 84 are respectively located at each corner of the bottom panel 10. The first gusset 72 extends between and is connected to the side panel 19 and the bottom end panel 60*a*. The second gusset 76 extends between and is connected to the side panel 19 and the bottom end panel 60*b*. The third gusset 80 extends between and is connected to the side panel 20 and the bottom end panel 60*a*. The fourth gusset 84 extends between and is connected to the side panel 20 and the bottom end panel 60*b*. The first and second gussets 72, 76 comprise a respective first gusset panel 73, 77 foldably connected to a respective one of the first bottom end panel 60*a* and the second bottom panel 60*b* at the lateral fold line 21 and a respective second gusset panel 74, 78 foldably connected to the adjacent side panel 19 at respective longitudinal lateral fold lines 61*a*, 61*b*. The respective first and second gusset panels 73, 77 and 74, 78 of the first and second gussets 72, 76 are foldably connected to one another at respective oblique fold lines 75, 79. Similarly, the third and fourth gussets 80, 84 comprise a respective first gusset panel 81, 85 foldably connected to adjacent bottom end panel 60*a*, 60*b* at the lateral fold line 22 and a respective second gusset panel 82, 86 foldably connected to the adjacent side panel 20 at respective longitudinal lateral fold lines 61*a*, 61*b*. The respective first and second gusset panels 81, 85 and 82, 86 of the first and second gussets 80, 84 are foldably connected to one another at respective oblique fold lines 83, 87.

In one embodiment, and as illustrated, the features for forming the handle 98 include the handle panel 40 comprising a handle aperture 90 generally centered in the handle panel 40. A tear line 91 extends from the handle aperture 90 into the top panel 30 and terminates at the apex of a v-shaped score line 92. A tear line 93 extends from the other end of the handle aperture 90 into the attachment flap 45 and terminates at the apex of a v-shaped score line 94. The handle panel 40 may also include stress directing score lines 96*a*, 96*b* extending between lateral fold lines 41, 47. As illustrated in FIG. 1 the score lines 96*a*, 96*b* may be arcuate or concave with respect to the handle aperture 90. The handle panel 40 can have other features for forming the handle 98 (FIG. 4) or the features shown could be otherwise shaped, arranged, and/or configured without departing from the disclosure.

Figure 2:
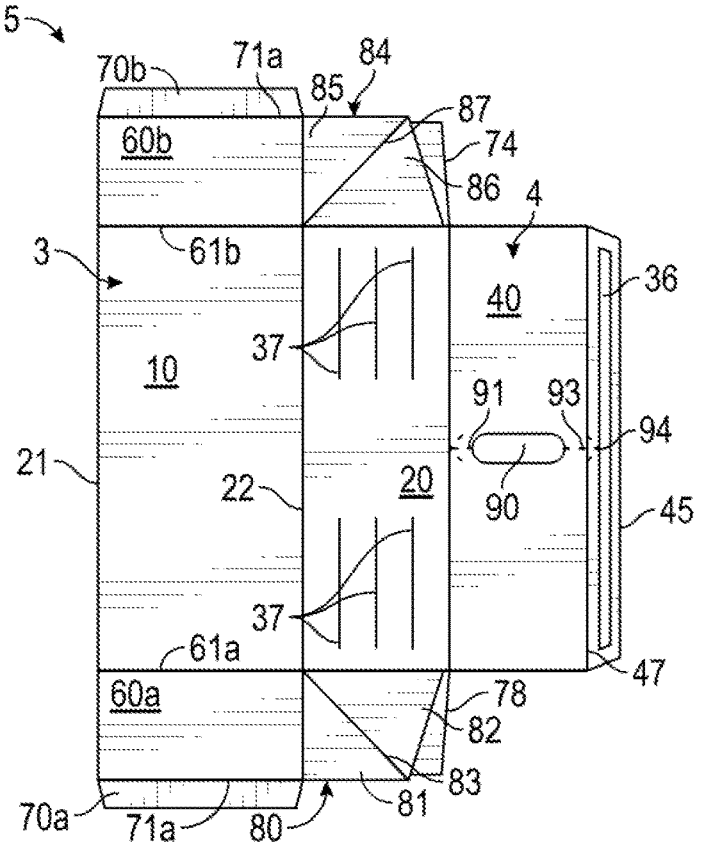
FIG. 2 is a first sequential view of a partial folding of the blank of FIG. 1.

An exemplary method of erecting the carton 7 from the blank 5 is discussed below with reference to FIGS. 2-4. The carton 7 can be erected with other methods or folding steps without departing from the disclosure.

Figure 3:
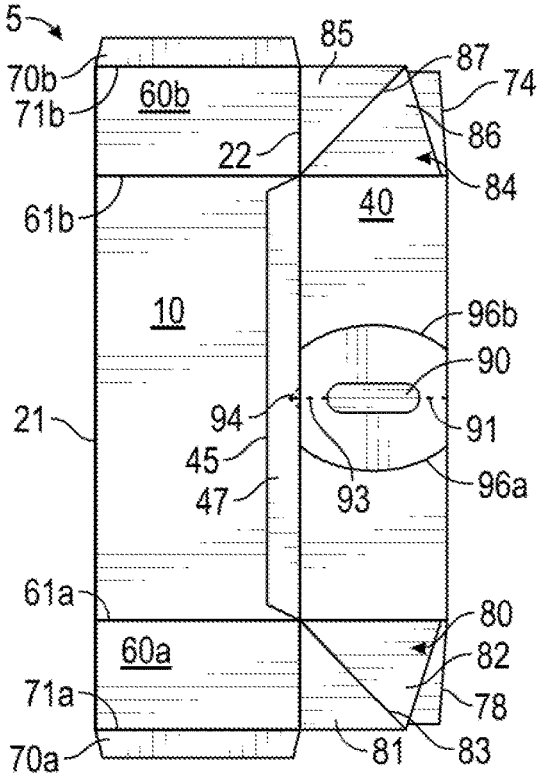
FIG. 3 is a second sequential view of a partial folding of the blank of FIG. 1.

Still referring to FIG. 1 and referring additionally to FIG. 3, the blank 5 is positioned with the exterior side 3 facing down and the exterior side 4 of the blank 5 facing up. The blank 5 is then folded first along fold line 21 to the position shown in FIG. 3 such that the second side panel 20 is in overlapping face-to-face contact with the top panel 30. The handle panel 40 is then folded about fold line 41 to be in overlapping face-to-face contact with the second side panel 20 and with the attachment flap 45 in overlapping face-to-face contact with the bottom panel 10. The interior surface 4 of the handle panel 40 can then be adhered to the exterior surface 3 of the blank 5 and in face-to-face contact with the second side panel 20. The attachment flap 45 can be adhered to a portion of the exterior surface 3 of the blank 5 and in face-to-face contact with a portion of the bottom panel 10 by lines of adhesive 36.

Figure 4:
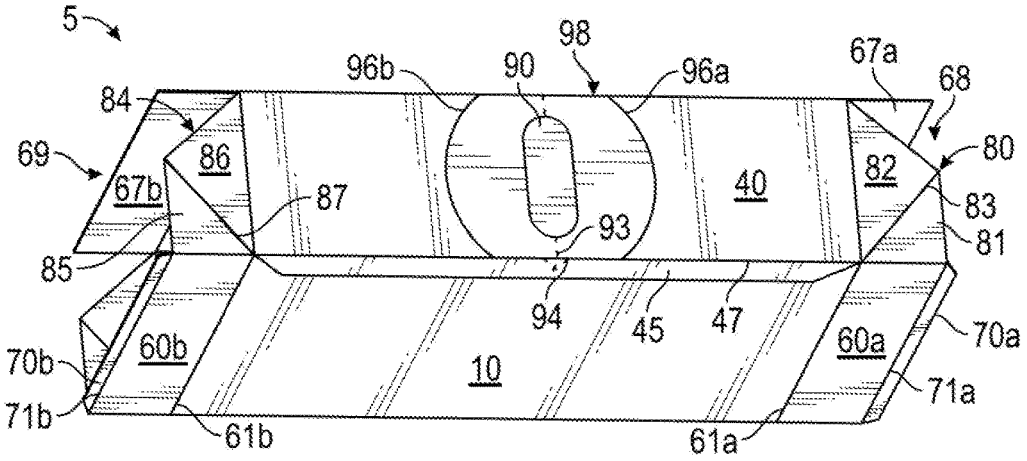
FIG. 4 is a third sequential view of a partial folding of the blank of FIG. 1.

Referring to FIG. 4, the partially erected blank 5 may then be opened up into a generally tubular form or sleeve having open ends 68, 69. The interior 8 of the carton 7 may be filled with articles such as, for example, generally cylindrical beverage containers (not shown) before closing one or both ends 68, 69 of the carton 7. From the tubular, open-ended carton form, the respective first and second gusset panels 73, 77, 81, 85 and 74, 78, 82, 86 are folded inwardly with respect to each other about the oblique fold lines 85, 79, 83, 87 such that the gussets 72, 76, 80, 84 are disposed in the interior 8 of the carton 7. Each bottom end panel 60*a*, 60*b* and closure flap 70*a*, 70*b* may be folded and the top end flaps 67*a*, 67*b* may be folded such that the top end flaps 67*a*, 67*b* of the top panel 30 overlap the bottom end panels 60*a*, 60*b* and closure flaps 70*a*, 70*b* and are adhesively attached thereto. The ends 68, 69 of the carton 7 can be closed by other features or forming steps without departing from the disclosure.

Figure 6:
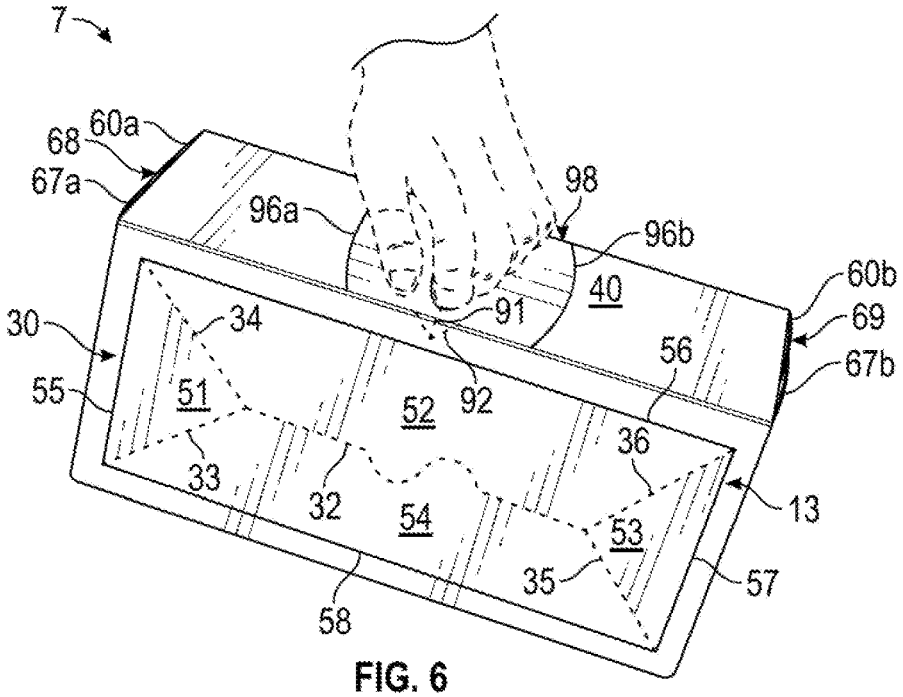
FIG. 6 is a perspective view of the carton of FIG. 5 being carried by a user.

Still referring to FIG. 5, and referring additionally to FIG. 6, the handle 98 includes the handle opening 90 in the handle panel 40 that overlays the side panel 20. The carton 7 can be grasped in the area of the handle 98 around the opening 90 in a first orientation (FIGS. 5) in which the handle panel 40 is upward facing so that the carton 7 can be lifted and carried (FIG. 6) at the handle 98 without tearing the side panel 20. The carton 7 having the formed handle 98 (FIG. 4) allows the consumer the ability to lift and transport the carton 7 by the handle aperture 90 without compromising the integrity of the bottom receptacle 11 and/or opening the access feature 13 of the carton. The score lines 37 of the second side panel 20 and score lines 94, 96*a*, 96*b* of handle panel 40 may permit relative movement of portions of second top panel 20 and handle panel 40 to inhibit or prevent tearing of carton 7. The carton 7 can be positioned to a second orientation (FIG. 7) in which the top panel 30 is upward facing to allow activation of the access feature 13 in the top panel.

In the illustrated embodiment, the carton 7 is loaded with eighteen generally cylindrical twelve-ounce beverage containers disposed in a 3×6×1 configuration. Embodiments with alternative configurations are considered within the scope of the present disclosure. The carton 7 generally has the shape of a parallelepiped. In embodiments, carton 7 may have a different configuration.

At each end 68, 69 of the carton 7, the end flaps 67*a*, 67*b* overlap the closure flap 70*a*, 70*b* and bottom end panel 60*a*, 60*b*. Each of the bottom end panels 60*a*, 60*b*, the side panels 19, 20, and the gussets 72, 76, 80, 84 cooperate to form a liquid-tight bottom receptacle 11.

Figure 7:
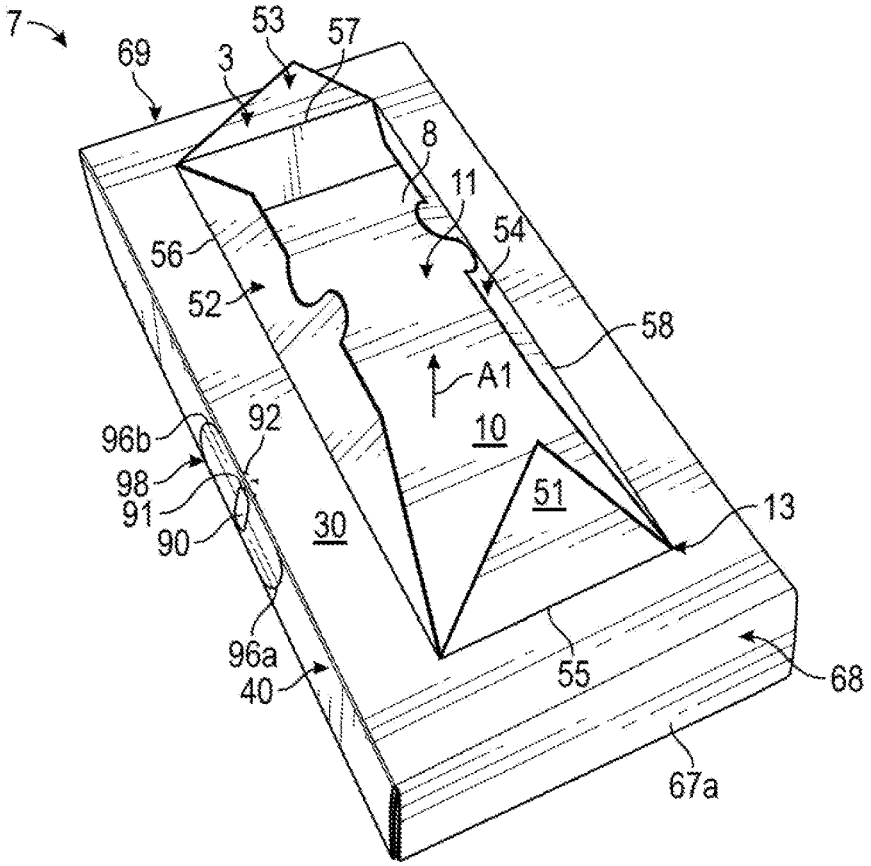
FIG. 7 is a perspective view showing an access feature of the carton of FIG. 5 being opened.

An exemplary method of accessing the carton and expanding the volume of the carton 7 is discussed below with reference to FIG. 7.

The access or dispensing features 13 of the carton 7 are activated by tearing the tear line 32 to form the top access flaps 51, 52, 53, 54. Such tearing may occur at a serpentine or sinusoidal portion of tear line 32, for example, such that an easily accessible portion is provided for engagement by a user's fingers or hands. Next, the top access flaps 51, 52, 53, 54 are folded upwardly about respective fold lines 55, 56, 57, 58 in the direction of arrow Al to provide access to the interior 8 of the carton 7.

The top access feature 13 is open to the interior 8 of the carton 7 to provide access to the bottom receptacle 11 and allow ice or other cooling material to be placed on top of containers and supported at a location above the containers. The interior 8 of the carton 7 may also be arranged such that ice or other cooling material can fall along the sides or near the base of containers stored therein. The top access flaps 51, 52, 53, 54 may be folded relative to the top panel 30 such that the flaps 51, 52, 53, 54 generally support the ice or other cooling material and provide a guided path to funnel the ice and associated melted cool water or other cooling material down onto the containers. The liquid-tight bottom receptacle 11 keeps the ice or other cooling material and associated runoff (e.g., cool water) from leaking from the carton 7 so that the containers stay cold. Containers housed in the bottom receptacle 11 can be accessed and withdrawn from the carton 7 through the top access feature 13 that allows access to the bottom receptacle 11. The top access feature 13 can have other features and be otherwise shaped, arranged, and/or configured without departing from the disclosure.

According to one aspect of the present disclosure, if desired, additional articles may be placed in the carton 7 after opening. For example, as ice melts, the carton 7 serves to retain all or a portion of the water runoff from the melting ice by the liquid-tight features of the bottom receptacle 11. In embodiments, a liner or liquid-resistant treatment may be applied to the interior surface 3 of carton 7 to facilitate maintenance of ice or other cooling material and associated runoff in the bottom receptacle 11.

The gussets 72, 76, 80, 84 may define in part the at least partially liquid-tight bottom receptacle 11 in the erected carton 7. The height of the top edge or upper border of the bottom receptacle 11 represents a portion of the bottom of the carton 7 below which no glued seals or seams are formed through which water or other liquid might leak. That is, no adhesive seal or other joinder of material where fluid might escape the carton 7 is located in the carton 7 at a position below the top edge of the bottom receptacle 11. The bottom receptacle 11 may therefore be formed from a continuous portion of folded material of the blank 5. The height of bottom receptacle 11 may be increased or decreased, for example, to accommodate larger or smaller anticipated liquid volumes in the carton 7.

The blank 5 can, for example, be constructed of water resistant material to any degree desired so that liquid in the bottom of the carton 7 remains in the carton 7 for a selected amount of time.

Cartons according to the principles of the present disclosure may be formed from materials such as, for example, paperboard. Therefore, if exposed to water or other liquids for extended periods of time, the carton may allow for the passage of liquid through the wetted carton surfaces due to partial permeability of the carton material. In this specification, the term "liquid-tight" is generally used to define a portion of a carton that is formed from a continuous portion of material or of a portion without any glued seams through which liquid or fine particulate matter might leak, and the term "liquid-tight" therefore encompasses cartons that may become partially water permeable over time due to prolonged exposure to water or other liquids. Further, it will be understood that cartons described herein may be lined or treated such that the carton configurations described herein are fluid-tight, e.g., resistant to the passage of both gaseous (e.g., vapor) and liquid materials therethrough.

In the above embodiments, the cartons are described as accommodating eighteen12-ounce cans containers in 3×6×1 configuration. Other arrangements of containers, packages, articles, and other items, however, can be accommodated within a carton constructed according to the principles of the present disclosure. For example, a carton constructed according to the principles of the present disclosure would also work satisfactorily if the carton were sized and shaped to hold articles in other configurations, such as 3×4×1, 4×6×1, 2×4×1, 2×5×1, 2×6×1, etc., and multi-tier variations of the aforementioned configurations.

The dimensions of the blanks may also be altered, for example, to accommodate various container forms. For example, bottles having any shape may be accommodated within a carton constructed according to the principles of the present disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper (e.g., a caliper of at least about 14). The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

The above embodiments may be described as having one or more panels adhered together by glue. The term "glue" is intended to encompass all manner of adhesives commonly used to secure carton panels in place.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. In the present specification, a "panel" or "flap" need not be flat or otherwise planar. A "panel" or "flap" can, for example, comprise a plurality of interconnected generally flat or planar portions.

For purposes of the description presented herein, the term "line of disruption" can be used to generally refer to, for example, a cut line, a score line, a crease line, a tear line, or a fold line (or various sequential and/or overlapping combinations thereof) formed in a blank. A "breachable" line of disruption is a line of disruption that is intended to be breached during ordinary use of the carton. An example of a breachable line of disruption is a tear line.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous or substantially continuous slit, or the like. For example, a cut line can be a continuous slit or could be wider than a slit without departing from the present disclosure.

In the illustrated embodiments, selected fold lines are shown as including spaced cuts to facilitate folding along the lines. If the cuts are below or adjacent to a bottom receptacle portion of a carton, less than 100% cuts may be used to prevent leakage along the fold lines. Alternatively, cuts or scores may be omitted within or near the receptacle portion.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles, the carton comprising:

a plurality of panels that extends at least partially around an interior of the carton, the plurality of panels comprising a bottom panel, a first side panel, a second side panel, a top panel, and a handle panel at least partially overlapping one of the first side panel and the second side panel;

at least one gusset foldably connected to the bottom panel and one of the first side panel and the second side panel; and an access feature formed in the top panel for accessing the interior of the carton; and a handle comprising a handle opening in the handle panel, the handle opening being spaced apart from the access feature and the handle panel and the handle opening are in face-to-face contact with the one of the first side panel and the second side panel.

2. The carton of claim 1, wherein the handle panel is foldably connected to the top panel.

3. The carton of claim 2, wherein the handle panel is adhesively connected to the one of the first side panel and the second side panel.

4. The carton of claim 2, wherein the handle panel comprises a handle portion adjacent the handle opening for grasping and carrying the carton.

5. The carton of claim 1, wherein the access feature comprises a line of weakening.

6. The carton of claim 5, wherein the line of weakening is a tear line that forms a plurality of access flaps in the top panel.

7. The carton of claim 6, wherein each access flap of the plurality of access flaps is foldably connected to the top panel at a respective fold line in the top panel.

8. The carton of claim 1, wherein the bottom panel comprises a first bottom end panel for closing a first end of the carton and a second bottom end panel for closing a second end of the carton.

9. The carton of claim 8, wherein the at least one gusset comprises a first pair of gussets at the first end of the carton and a second pair of gussets at the second end of the carton.

10. The carton of claim 9, wherein each gusset of the first pair of gussets comprises a first gusset panel foldably connected to the first bottom end panel and a second gusset panel foldably connected to one of the first side panel and the second side panel.

11. The carton of claim 10, wherein each gusset of the second pair of gussets comprises a third gusset panel foldably connected to the second bottom end panel and a fourth gusset panel foldably connected to one of the first side panel and the second side panel.

12. The carton of claim 1, the carton being configured for orientation in at least a first orientation in which the handle panel is upward-facing such that that the carton can be carried at the handle opening and a second orientation in which the top panel is upward-facing such that a cooling material can be deposited through the access feature into the interior of the carton.

13. The carton of claim 1, wherein the carton comprises a bottom receptacle comprising the first side panel and the second side panel, the bottom receptacle is a continuous portion of the carton devoid of any seams or seals.

14. The carton of claim 13, wherein the handle panel is attached to the bottom receptacle and the access feature is for allowing access to the bottom receptacle.

15. The carton of claim 1, wherein the one of the first side panel and the second side panel prevents access to the interior of the carton through the handle opening.

16. A blank for forming a carton for holding a plurality of articles, the blank comprising:

a plurality of panels comprising a bottom panel, a first side panel, a second side panel, a top panel, and a handle panel for at least partially overlapping one of the first side panel and the second side panel in the carton formed from the blank;

at least one gusset foldably connected to the bottom panel and one of the first side panel and the second side panel; and an access feature formed in the top panel for accessing the interior of the carton formed from the blank; and handle features comprising a handle opening in the handle panel, the handle opening being spaced apart from the access feature and the handle panel and the handle opening are in face-to-face contact with the one of the first side panel and the second side panel in the carton formed from the blank.

17. The blank of claim 16, wherein the handle panel is foldably connected to the top panel.

18. The blank of claim 17, wherein the handle panel is adhesively connected to the one of the first side panel and the second side panel.

19. The blank of claim 17, wherein the handle panel comprises a handle portion adjacent the handle opening for grasping and carrying the carton formed from the blank.

20. The blank of claim 17, wherein bottom panel comprises a first bottom end panel for closing a first end of the carton formed from the blank and a second bottom end panel for closing a second end of the carton formed from the blank.

21. The blank of claim 20, wherein the at least one gusset comprises a first pair of gussets at the first end of the bottom panel and a second pair of gussets at the second end of the bottom panel, each gusset of the first pair of gussets comprises a first gusset panel foldably connected to the first bottom end panel and a second gusset panel foldably connected to one of the first side panel and the second side panel.

22. The blank of claim 21, wherein each gusset of the second pair of gussets comprises a third gusset panel foldably connected to the second bottom end panel and a fourth gusset panel foldably connected to one of the first side panel and the second side panel.

23. The blank of claim 16, wherein the access feature comprises a line of weakening, the line of weakening is a tear line that forms a plurality of access flaps in the top panel, and each access flap of the plurality of access flaps is foldably connected to the top panel at a respective fold line in the top panel.

24. The blank of claim 16, wherein the first side panel and the second side panel are for forming a bottom receptacle in the carton formed from the blank, the bottom receptacle is a continuous portion of the carton formed from the blank that is devoid of any seams or seals.

25. A method of forming a carton for holding a plurality of articles, the method comprising:

obtaining a blank comprising a plurality of panels comprising a bottom panel, a first side panel, a second side panel, a top panel, and a handle panel at least partially overlapping one of the first side panel and the second side panel, at least one gusset foldably connected to the bottom panel and one of the first side panel and the second side panel, an access feature formed in the top panel, and handle features comprising a handle opening in the handle panel;

forming an interior of the carton for holding the plurality of articles by positioning the plurality of panels;

forming the handle by positioning the handle panel to at least partially overlap at least one of the first side panel and the second side panel, the handle opening being spaced apart from the access feature and the handle panel and the handle opening are in face-to-face contact with the at least one of the first side panel and the second side panel.

26. The method of claim 25, wherein the handle panel is foldably connected to the top panel and the forming the handle comprises adhesively connecting the handle panel to the at least one of the first side panel and the second side panel.

27. The method of claim 26, wherein the handle panel comprises a handle portion adjacent the handle opening for grasping and carrying the carton.

28. The method of claim 25, wherein the access feature comprises a line of weakening, the line of weakening is a tear line, and the method comprises activating the access feature by tearing along the tear line to form a plurality of access flaps in the top panel.

29. The method of claim 28, wherein each access flap of the plurality of access flaps is foldably connected to the top panel at a respective fold line in the top panel, and the activating the access feature comprises positioning the plurality of access panels to allow access to the interior of the carton.

30. The method of claim 25, wherein the bottom panel comprises a first bottom end panel and second bottom end panel, the method comprising positioning the first bottom end panel to close the first end of the carton and positioning the second bottom end panel to close the second end of the carton.

31. The method of claim30, wherein the at least one gusset comprises a first pair of gussets at the first end of the carton and a second pair of gussets at the second end of the carton.

32. The method of claim 31, wherein each gusset of the first pair of gussets comprises a first gusset panel foldably connected to the first bottom end panel and a second gusset panel foldably connected to one of the first side panel and the second side panel, each gusset of the second pair of gussets comprises a third gusset panel foldably connected to the second bottom end panel and a fourth gusset panel foldably connected to one of the first side panel and the second side panel.

33. The method of claim 30, wherein the carton comprises a bottom receptacle comprising the first side panel and the second side panel, the bottom receptacle is a continuous portion of the carton devoid of any seams or seals, the forming the handle comprises attaching the handle panel to the bottom receptacle.

34. The method of claim 33, wherein the method comprises grasping and carrying the carton at the handle without activating the access feature.

35. The method of claim 25, wherein the carton is configured in a first orientation in which the handle panel is upward-facing such that that the carton can be carried at the handle opening, the method comprises positioning the carton to a second orientation in which the top panel is upward-facing and activating the access feature to allow a cooling material to be deposited through the access feature into the interior of the carton.

* * * * *